US006019267A

United States Patent [19]

Shill et al.

[11] Patent Number: 6,019,267

[45] Date of Patent: Feb. 1, 2000

[54] BUNDLE BREAKER

[75] Inventors: David Shill, Spokane; Travis W. Hanson, Newport, both of Wash.

[73] Assignee: Thermoguard Equipment, Inc., Spokane, Wash.

[21] Appl. No.: 09/010,975

[22] Filed: Jan. 23, 1998

Related U.S. Application Data

[62] Division of application No. 08/673,141, Jul. 1, 1996, Pat. No. 5,791,539.

[51] Int. Cl.[7] ..... B26F 3/02

[52] U.S. Cl. ..... 225/101; 225/103

[58] Field of Search ..... 225/100, 101, 225/102, 103, 106, 93, 96.5

[56] References Cited

U.S. PATENT DOCUMENTS

| | | | |
|---|---|---|---|
| 1,669,999 | 5/1928 | Olsen | 225/100 X |
| 2,761,506 | 9/1956 | Rutkus et al. | 225/101 X |
| 3,133,684 | 5/1964 | Wiltshire et al. | 225/101 X |
| 3,268,136 | 8/1966 | Huffman | 225/101 X |
| 3,268,138 | 8/1966 | Bangert | 225/101 X |
| 4,069,957 | 1/1978 | Moffitt | 225/5 |
| 4,132,337 | 1/1979 | Masuda et al. | 225/5 |
| 4,500,022 | 2/1985 | Lucas | 225/101 X |
| 4,623,081 | 11/1986 | Hain et al. | 225/5 X |
| 4,714,035 | 12/1987 | Engle | 225/101 X |
| 4,987,723 | 1/1991 | Diemer | 225/101 X |
| 5,255,008 | 10/1993 | Yoshida | 225/101 X |

FOREIGN PATENT DOCUMENTS

| | | | |
|---|---|---|---|
| 0 292 067 B2 | 11/1988 | European Pat. Off. . | |
| 2 172 538 | 9/1986 | United Kingdom | 225/100 |

*Primary Examiner*—Rinaldi I. Rada
*Assistant Examiner*—Charles Goodman
*Attorney, Agent, or Firm*—Wells, St. John, Roberts, Gregory & Matkin, P.S.

[57] ABSTRACT

Method and apparatus for separating a bundle of blank pieces from a stack of sheets. The apparatus has a frame and a subframe which pivots with respect to the frame. The frame and subframe each have a clamp for clamping the stack of sheets along a stack plane and the bundle portion to be separated from the stack along a separation plane that intersects the stack plane. The subframe pivots with respect to the frame, bending the stack to cause the bundle portion to be separated from the remainder of the stack in such a way that separation is initiated at one point along the stack rather than across the whole stack or across an entire sheet of the stack. The subframe pivots about an axis that is skewed with respect to at least one of the planes to produce the described effect. Pressure sensors are included to detect the pressure being applied to the stack of sheets to ensure that sufficient force is applied to hold the stack steady in tension during the pivotal motion of the subframe, and yet avoid damage to the stack by the clamps.

18 Claims, 14 Drawing Sheets

BUNDLE BREAKER

RELATED PATENT DATA

This patent resulted from a divisional application of U.S. patent application Ser. No. 08/673,141, which was filed on Jul. 1, 1996 and now U.S. Pat. No. 5,791,539.

TECHNICAL FIELD

This invention relates to machines for handling stacks of sheets of semi-rigid material and is particularly directed towards apparatus for separating each sheet in the stack along a separation line, and more particularly for handling sheets of corrugated material in this manner.

BACKGROUND OF THE INVENTION

In the manufacture of corrugated boxes and other corrugated goods, a large sheet of corrugated fiberboard is passed through a machine which will die cut the blank or flat shape of corrugated boxes or other objects which are to be constructed from the sheet of corrugated fiberboard. The sheets of corrugated fiberboard may be die cut in a press which acts in the manner of a die cutting machine to stamp the pattern of the blank into the fiberboard. Alternately, the sheet of fiberboard may pass through a rotary die which will cut and emboss the blank pattern of the final shape of the knock-down carton or the like to be made from the sheet.

To simplify handling of the corrugated material, the die cut blanks are not separated completely from the sheet, but are left partially joined along adjacent edges which will separate under tension to produce the individual blanks for later formation into cartons, boxes, or other objects. This allows for simplified handling in that the process only needs to handle complete sheets rather than all of the individual blanks. Since several blanks may be separated from a single sheet, there is an increase in efficiency from handling a single sheet versus a multitude of blanks cut from the sheet.

However, at some point the blanks defined by the rotary press or the platen die press will need to be separated so that they may be individually bundled and shipped or further processed into finished goods. In the manufacture of corrugated goods it is desirable to remove as many bottlenecks from the process as possible by minimizing handling steps. It is therefore desirable to separate the blanks from the primary sheet or sheets in a minimal number of steps.

One method to minimize the number of handling steps is to collect several sheets into a stack and then separate the stack into bundles of blanks. The more sheets in a stack of corrugated fiberboard which can be handled at one time, the more efficient the process will be. However, as more sheets are accumulated into a stack to increase throughput, a larger force will be required to separate a stack of fiberboard along the defined separation line.

Some die cutting processes will cut away portions of the corrugated sheet along a line defining the separation path of the blank to be separated from the fiberboard. In the cut away area, small tabs will be left so the blank does not separate from the primary sheet. The small tabs are termed "nicks" and a sheet with die-cut blanks held in place by nicks is termed a "nicked sheet." Alternately, the die may impress a crease along the fiberboard or partially cut through the fiberboard to define the separation path. Either of these processes will create an area of weakened tensile strength such that when the fiberboard is subjected to a tensile force acting in the plane of the sheet, the sheet will tear or separate along the defined separation path. Since a multitude of separation paths may be imposed into a single sheet of fiberboard, it is necessary to impose the tensile strength required to separate the sheet along a selected separation line, rather than subjecting the entire sheet to tensile strength with resultant random separation along the separation lines.

One method for separating a bundle of blanks from a stack of nicked sheets consists of grasping the stack of corrugated sheets along either side of a plane of separation paths passing through the stack of sheets and then pulling the two grasped portions apart to sever the bundle from the remaining stack. As the stacks become higher to increase the rate of through put, more tensile force is required to separate the bundle from the stack. In order to achieve greater tension forces, larger grasping or clamping forces must be applied to the stack. At a certain point, the compressive forces applied by the clamps on either side of the separation path become so high that the fiberboard is damaged by the clamps. On the other hand, too little clamping force will result in the fiberboard slipping from the clamps during the pulling process.

It is therefore desirable to produce a apparatus for separating bundles of blanks from a stack of nicked sheets having such blanks die cut within the individual sheets, which allows for large stacks of sheets to be processed without damaging the sheets themselves in the process.

BRIEF DESCRIPTION OF THE DRAWINGS

Preferred embodiments of the invention are described below with reference to the following accompanying drawings.

FIG. 4 is a side elevational view of the apparatus of the present invention showing a stack of corrugated sheets being fed into the apparatus.

FIG. 5 is a side elevational view of the apparatus of the present invention showing the apparatus in operation separating a bundle of corrugated pieces from the stack of corrugated sheets.

FIG. 6 is a side elevational view of the apparatus of the present invention showing the operation of the apparatus after the bundle of corrugated pieces has been separated from the remainder of the stack of sheets.

FIG. 7 is a side elevational view of the apparatus of the present invention showing the process for removing the bundle from the remainder of the stack and feeding of the remainder of the stack into the apparatus.

FIG. 12 is an end view of the apparatus of the invention showing FIG. 1 showing the skewed pivot axis of the subframe.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 13:
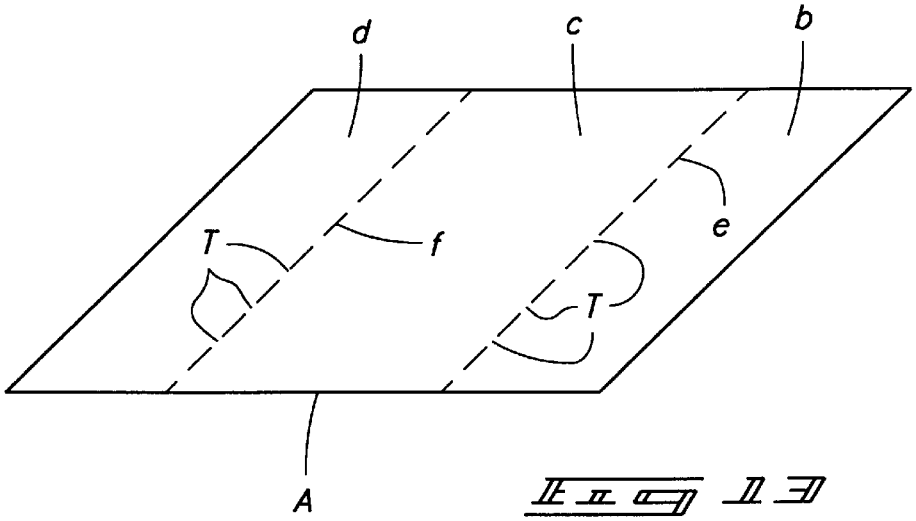
FIG. 13 is a graphic perspective view of a single sheet showing three blank shapes die-cut therein and the separation lines defining the individual blanks.

In the manufacture of cardboard boxes and other items made of corrugated fiberboard, a large sheet of fiberboard will be processed in a die or other cutting device to cut one or more blanks (flat patterns) from the corrugated sheet. Such a sheet A is shown in FIG. 13, with blanks b, c, d formed therein and defined by die cut separation lines e and f. As previously discussed, it is not desirable to completely cut the blanks away from the entire sheet but to leave the blanks connected in such a manner that the entire sheet may be handled as a single entity rather than a multitude of individual blanks. This considerably reduces handling time and increases productivity over systems requiring individual handling of the die-cut blanks.

Current processes for partially cutting without separating the blanks from the entire sheet may include leaving small tabs T (FIG. 13) along the die-cut separation lines e, f or embossing or partially cutting along the separation lines e, f so as to create points (hereafter termed "nicks") of weakened tensile strength in the sheet. As noted above, a sheet having partially cut blanks is termed a "nicked sheet."

Figure 14:
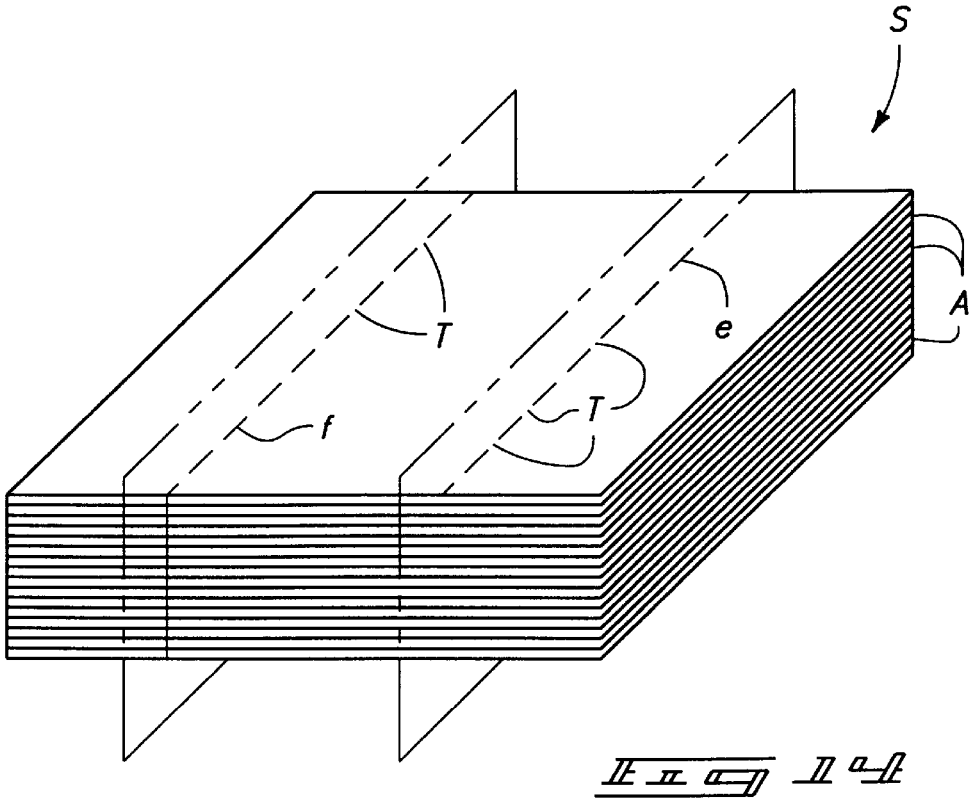
FIG. 14 is a graphic perspective view showing a stack of sheets of the nature shown in FIG. 13, with the respective separation lines aligned along separation planes identified by phantom lines.
Figure 15:
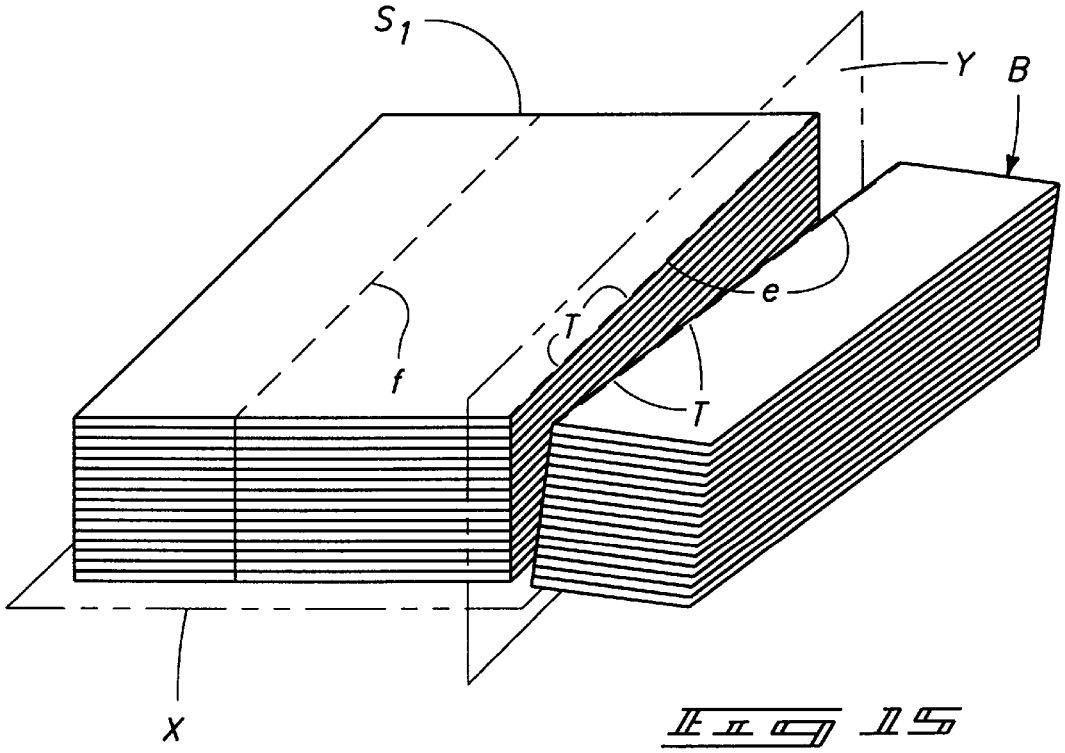
FIG. 15 is a graphic perspective view showing a stack of sheets being broken, with a bundle of blanks separating from the stack remainder along a separation plane.
Figure 16:
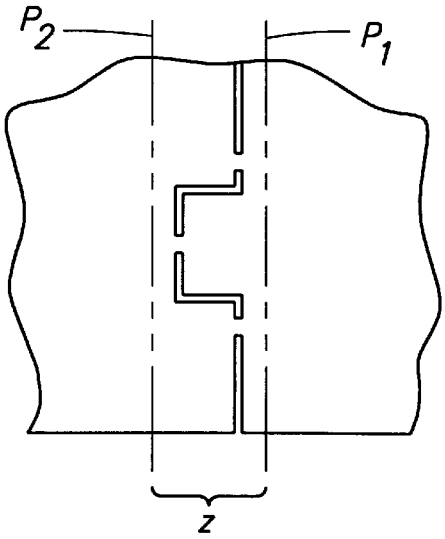
FIG. 16 is a fragmented enlarged plan view showing a separation zone and an irregular separation line along a sheet.

At some point in the manufacturing process, it is necessary to separate the defined blanks from the rest of the nicked sheet so that the blanks may be shipped individually or may be further constructed into erected cartons and the like. As previously discussed, to increase productivity it is desirable to perform this separation process such that a number of sheets A may be formed into a stack S with the separation lines of successive sheets in alignment (FIG. 14). This is typically done by stacking a number of sheets together along a stack plane X (FIG. 15), with respective sets of separation lines e, f in alignment. The stack is then grasped on opposite sides of a selected one of the separation lines and placed in sufficient tension to break the nicks and thereby separate a bundle B (FIG. 15) of individual blanks from the stack. The remainder of the stack $S_1$ (FIG. 15) then becomes subject to the same process, repeatedly until all the individual blanks are separated. Typically, the separation lines in individual sheets in the stack will be aligned so that they are roughly in the same plane as shown by phantom lines in FIG. 14. Oftentimes, the separation line will orthogonally traverse the sheet from one side to another creating an essentially straight separation line. Other times, however, the shape of the finished product may dictate that the separation line take a jog (see FIG. 16) or be in more than one plane. The present invention is configured to handle both instances. Further, when a plurality of sheets are stacked together, the separation lines may not align in a plane perfectly bisecting the stack, but may in fact overlap slightly. Therefore, in the present invention when we discuss a "separation plane Y" it is understood that separation lines considered to be within the separation plane Y may in fact vary slightly from one side of the plane to the other. As used herein, "separation plane Y" is considered to be within an area that zone Z (FIG. 16) between two planes $P_1$, $P_2$ perpendicular to the stack of nicked sheets which contains all of the individual separation lines that will define a particular edge surface in a bundle of blanks to be separated from the stack. We also use the term "separation zone Z" herein to define that zone between two planes $P_1$ and $P_2$ perpendicular to the stack which contains separation lines that traverse the stack of sheets, wherein a non-straight separation line may define an edge of the blank to be removed from the sheet. Such a zone and irregular separation line are shown in FIG. 16.

Thus, a stack of blanks removed from the stack of sheets will be described herein as a "bundle." A bundle will be considered as that portion of a stack to be separated or which has been separated from the remainder of the stack of sheets originally presented for separation.

While the invention is described herein as applying primarily to corrugated material, it is understood that the apparatus and method can be used equally effectively with uncorrugated fiberboard, sheets of plastic, sheets of fiberglass, or other semi-rigid material which lends itself to tearing in tension. It is also understood that the apparatus and method may apply equally well to thin sheets of wood. In fact, no predefined weakened separation line may be required for certain relatively brittle materials.

The Frame

Figure 1:
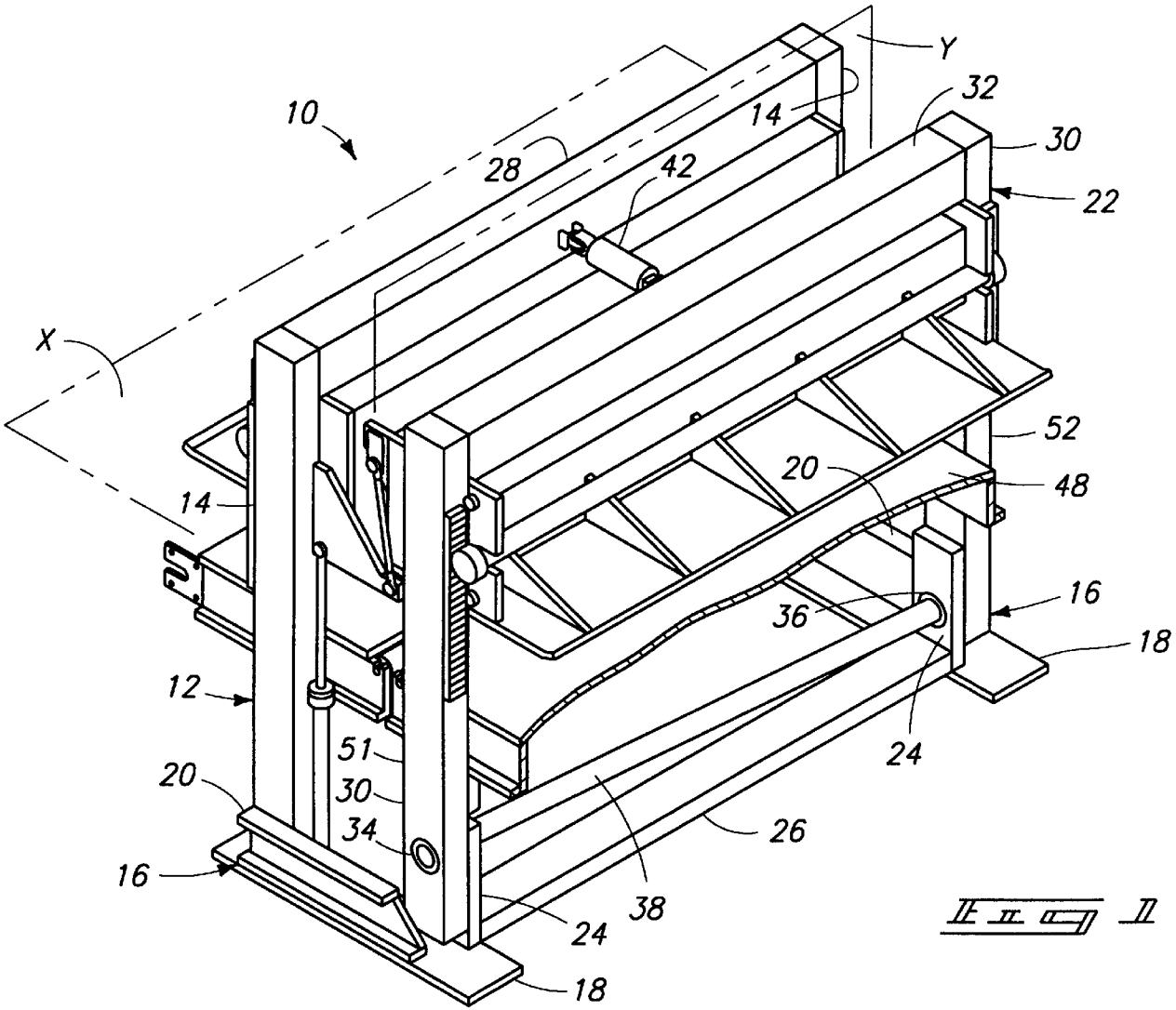
FIG. 1 is an isometric view of the apparatus of the current invention which is used for separating bundles of corrugated materials from a stack of corrugated sheets.

Turning now to FIG. 1, one form of the apparatus 10 of the present invention is shown in an isometric view. The apparatus has a frame 12 which acts as the primary stationary support for moving parts which are more fully described below. Frame 12 consists of two upright beams 14 which act as side members for primary structural stability and rigidity of the apparatus.

At their lower end, side members 14 are connected in orthogonal spatial relationship to frame support members 16. Frame support members 16 provide primary upright stability to the frame 12 and the apparatus 10 generally.

Frame support members 16 comprise a mounting plate 18 which is used to mount the apparatus to the floor of workshop or to other surface where it is desired to install the apparatus. Frame support members 16 further comprise a subframe brace 20, a section of channel iron extending at right angles to frame side members 14 and which is rigidly attached to mounting plates 18. Subframe brace 20 provides additional stability for the subframe 22, which is more particularly described below.

Attached to mounting plate 18 at each side of the apparatus is a subframe stanchion 24 which is an upright bracket. Subframe brace 20 and subframe stanchion 24 are spaced apart to form a guide channel there-between. This channel receives the subframe 22 for pivotal movement as described more fully below. Between the two subframe stanchions 24 is a frame lower cross-member 26. Lower cross-member 26 is rigidly attached to the subframe stanchions, and may also be is attached to mounting plates 18.

Disposed between upright side beams 14 is frame upper cross-member 28, which provides further rigidity to the apparatus.

In a preferred embodiment of the present invention, the stationary frame 12 is formed by side members 14 and upper cross member 28, frame support member 16, subframe stanchions 24, and frame lower cross member 26, to provide an essentially rigid structure. It is desirable that the frame 12 have a reasonably high degree of rigidity due to stresses which will be imposed on the frame by the action of a spreader operating against the subframe and clamps, which are further described below.

It is seen that frame side members 14 and frame upper cross member 28 form an essentially inverted U-shaped structure. Stacks of sheets of corrugated material from which bundle portions are to be separated will pass through the rectangular opening formed by side members 14 and upper cross member 28.

The Subframe

Referring still to FIG. 1, the subframe 22 is shown as part of the apparatus 10. Subframe 22 comprises subframe upright side members 30 which are rigidly connected to and spaced apart by subframe upper cross member 32. Subframe 22 is generally a mirror image of the portion of the frame formed by frame upright side members 14 and frame upper cross member 28. Subframe 22 thus also forms an inverted U-shaped section.

As with frame 12, subframe 22 should be a rigid structure capable of withstanding bending and torsional stresses imposed on the subframe as result of the operation of the apparatus. The lower ends of subframe side members 30 fit between subframe braces 20 and subframe stanchions 24 that are joined by a lower cross member 26.

Subframe 22 is mounted to frame 12 between subframe braces 20 and subframe stanchions 24 at pivot points 34 and 36. Pivot points 34 and 36 comprise bearing mounted pivots for receiving the ends of pivot shaft 38. Pivot shaft 38 passes through upright stanchions 24 or is preferably mounted in spherical bearings in stanchions 24. The ends of pivot shaft 38 then extend through upright stanchions 24 and are finally supported by the bearings at pivot points 34 and 36.

As an alternative to using a pivot shaft 38, studs (not shown) may be attached to the outsides of subframe stanchions 24 which extend to be received by the bearings at pivot points 34 and 36. In the preferred embodiment, the pivot shaft 38 is used to simplify assembly and to provide a more rigid structure.

The pivot axis defined by points 34 and 36 is skewed in that it intersects either or both of the plane X of the stack of sheets or the separation plane Y. In the preferred form, the vertical distance from the plane X containing pivot clamp lower element 48 to pivot point 34 is greater than the vertical distance from the same plane X to second pivot point 36. As a result of the unequal distance, the axis connecting pivot points 34 and 36, is skewed with respect to the subframe upper cross member 32, and further with respect to an orthogonal orientation to subframe upright side members 30. In the preferred embodiment, the axis connecting pivot points 34 and 36 is defined by pivot shaft 38. Turning briefly to FIG. 12, the skewed orientation of pivot shaft 38 with respect to the plane X containing pivot clamp lower element 48 pivot shaft 38 with respect to the plane containing pivot clamp lower element 48 is clearly seen.

Frame 12 and subframe 22 are connected at frame upper cross member 28 and subframe upper cross member 32 by spreader 42. Spreader 42 is preferably a hydraulic ram which is used to push subframe upper cross member 32 away from frame upper cross member 28, or alternately to pull upper frame cross member and subframe upper cross member together. Although in the preferred embodiment, spreader 42 is a hydraulic cylinder, a pneumatic cylinder may also be used. In the preferred embodiment, a single spreader 42 provided in the form of a hydraulic ram is used, connected to each upper cross member by a universal joint, allowing the ram to move freely as subframe 22 moves toward and away from frame 12.

It is seen that since subframe 22 is pivotally attached to frame 12 at pivot points 34 and 36, as ram 42 is actuated to extend, subframe upper cross member 32 will be pushed away from frame upper cross member 28.

Briefly referring to FIG. 5, it can be seen that the result of this spreading action will be that subframe 22 will pivot about the pivot shaft 38 and pivot points 34 and 36. Frame 12 will remain stationary by virtue of frame mounting plates 18.

Figure 2A:
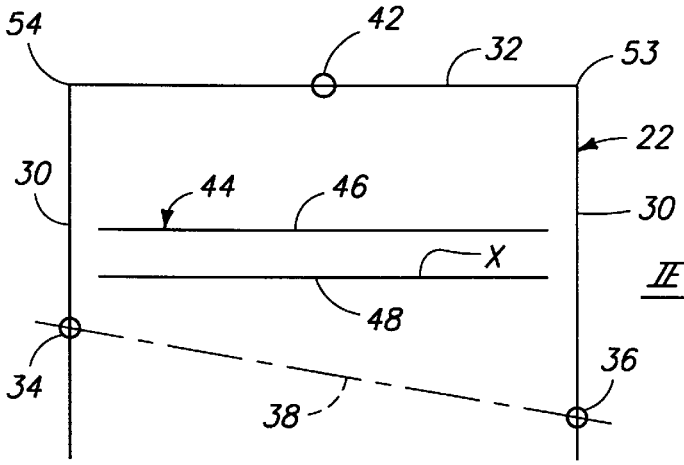
FIG. 2A is a schematic showing an end view of the apparatus of the invention shown in FIG. 1 and particularly the skewed pivot axis for the subframe.

Referring now to FIG. 2A, a schematic end view of the apparatus of FIG. 1 is shown to demonstrate the effect of skewed pivot axis 38. FIG. 2A shows the subframe 22 defined by subframe side members 30 and subframe upper cross member 32, which is mounted orthogonal to subframe side members 30. Disposed between subframe side members 30 is pivot clamp 44 (described below), which receives the portion of the stack of sheets to be separated from the remainder of the stack. It is understood that sheets of material received within pivot clamp 44 will be initially orthogonal to the separation plane Y defined by subframe 22, and will lie parallel to the plane X which is parallel to pivot clamp upper element 46 and pivot clamp lower element 48. It can therefore be seen that pivot shaft 38 and consequently the pivot axis connecting pivot points 34 and 36 will intersect the planes containing the pivot clamp upper and lower elements 46 and 48, as well as the stack plane X. It should also be understood that the pivot axis could be positioned to intersect the separation plane X, or both planes X and Y.

Figure 2B:
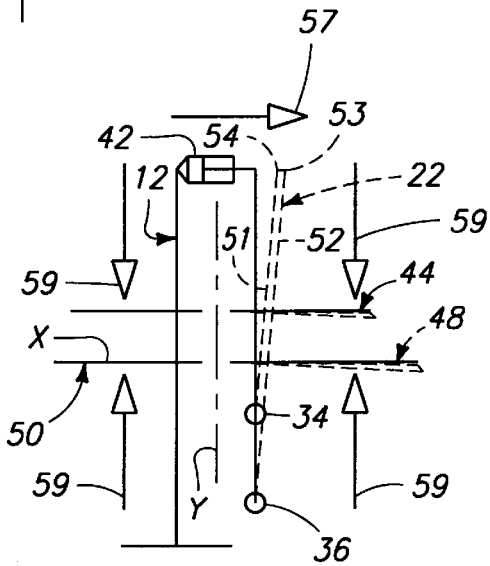
FIG. 2B is a schematic side view of the apparatus of the invention shown in FIG. 1 showing the offset achieved by the subframe as a result of pivoting about the skewed axis.

Referring now to FIG. 2B, a schematic side view of the apparatus of FIG. 1 is shown. As described above, when ram 42 is actuated, subframe 22 will be caused to pivot in direction 57 away from frame 12 about the pivot axis between pivot points 34 and 36.

Figure 2C:
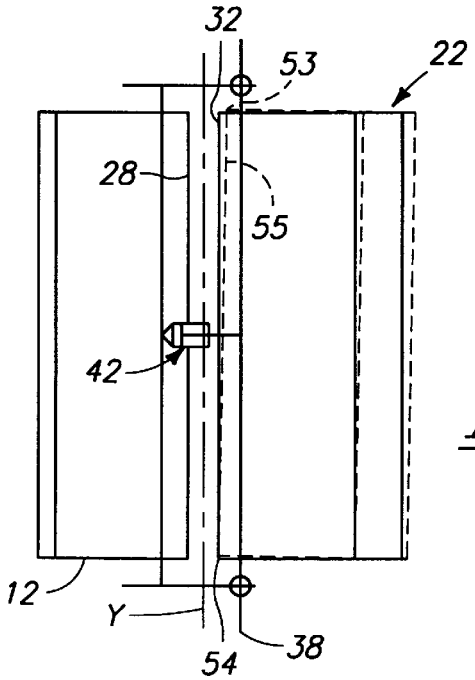
FIG. 2C is a schematic top view of the apparatus of the invention of FIG. 1 showing the displacement of the subframe as a result of pivoting about the skewed axis.

The response of the subframe to the pivoting action caused by actuation of spreader 42 will be dictated by the fixed pivot points of the apparatus. Specifically, subframe 22 must rotate about the pivot shaft 38 by virtue of the fixed pivot points 34 and 36. Further, the distal separation between frame upper cross member 28 and subframe upper cross member 32 at the ram 42 is a distance fixed by ram 42. Since the distance between right pivot 36 and the top of subframe right side member 52 is greater than the distance between left pivot 34 and the top of subframe left side member 51, subframe upper right corner 53 will travel a further distance than subframe upper left corner 52. As a result, subframe upper cross member 32 will be pushed from its initial position of being parallel to frame upper cross member 28 into a position where it is not parallel to frame upper cross member 28. This effect is shown in FIG. 2C where it can be seen that frame upper cross member 28 and subframe upper cross member 32 are initially parallel.

After activation of ram 42, subframe upper cross member 32 has moved to position 55, which is clearly not parallel to frame upper member 28. Thus, the distance between subframe upper right corner 53 and frame upper cross member 28 becomes greater than the distance between subframe upper left corner 54 and frame upper cross member 28. However, the axis defined by pivot shaft 38 remains consistent with respect to frame upper cross member 28. The effect is that subframe is 22 rotates away from frame 12 at an uneven rate such that the right side of subframe 22 moves away from frame 12 faster than the left side of subframe 22. Referring again to FIG. 2B, it can be seen that the effect is that a stack of sheets grasped in the direction 59 between stack clamp 50 and pivot clamp 44 will be separated in tension as subframe 22 pivots away from frame 12. However, since the right side of subframe 22 will pull away from frame 12 faster than will the left side of subframe 22, the separation of the bundle of sheets from the remaining stack will be initiated on the right side of the bundle, as is clear from FIG. 2C. Further, as is clear from FIG. 2B, since subframe 22 separates from frame 12 faster at the top of frame 12 than at the bottom, the bundle will also start to separate at the top sheet of the stack and will progressively separate down through to the bottom sheet.

The effect of the two combined separation occurrences is that the bundle will initially start to separate from the remaining stack of sheets at the upper right corner of the bundle. The result is that all separating forces are initially applied to the single corner of the stack of sheets, rather than being applied all across the full stack, or even across the single top sheet of the stack. Consequently, less tensile force is needed to tear the bundle away from the remainder of the stack, since force sufficient only to initiate separation at one corner of the stack is required.

Since the stack of sheets and the bundle to be separated are held in tension by the frictional forces imposed by stack clamp 50 and pivot clamp 44 in direction 59 of FIG. 2B, a smaller frictional force is required where less tensile force is required to separate the bundle from the stack. Since frictional force is proportional to the compressive force on the stack (assuming the co-efficient of friction remains constant), it can be seen that less compressive force will be required by stack clamp 50 and pivot clamp 44 if the necessary tensile force can be reduced. Since smaller compressive forces can be used with the apparatus of the present invention, the likelihood of damage to the stack of corrugated sheets is reduced.

While the apparatus has been described as having the pivot axis skewed so as to be lower on the right side of the apparatus than on the left, it can be seen that the same effect can be achieved by making the left pivot point 34 lower than the right pivot point 36.

Likewise, it can be seen that the pivot axis defined by pivot shaft 38 could be located towards the upper portion of subframe side members 30, and the subframe could be configured to pivot about an axis at that point. In that configuration, the actuator 42 would be located towards the bottom of the apparatus near frame lower cross member 26. Configured with the pivot axis in the upper position, the subframe would pivot outward and away from frame 12 near the frame lower cross member 26.

Whatever the selected orientation of the pivot axis, the effect produced by the single hydraulic ram 42, will be such that one corner of the subframe will move further away from the frame upper cross member 28 than the other corner of the subframe so as to achieve the desired effect of initiating separation of the bundle from the stack starting at a single corner.

The Clamps

Figure 3:
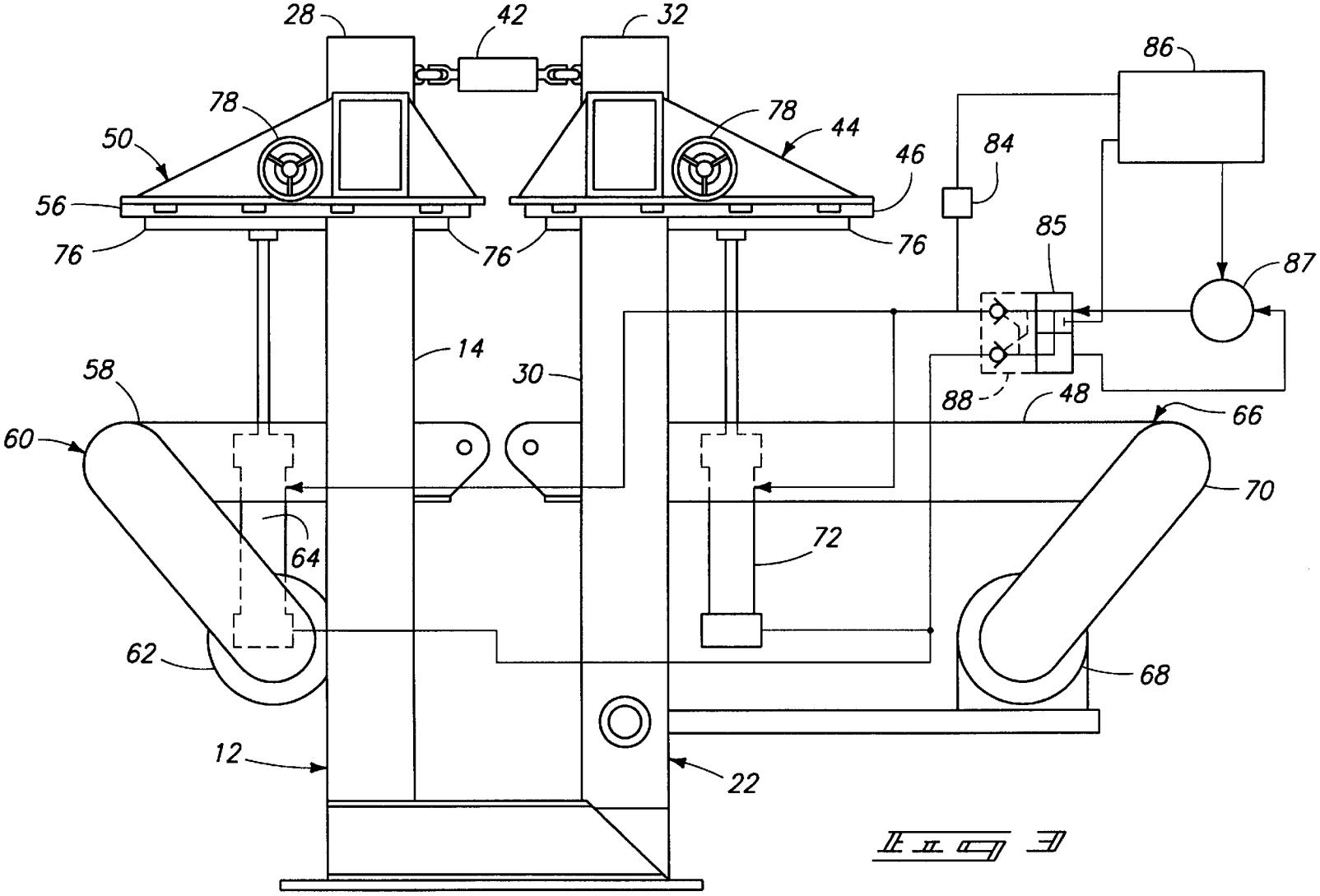
FIG. 3 is a side elevational view of the apparatus of the present invention showing the clamps for grasping the stack, the conveyors of the lower clamp elements, and a control schematic.

Referring now to FIG. 3, a schematic side view of the apparatus of FIG. 1 is shown. Disposed between frame 12 upright members 14 and frame upper cross member 28 is stack clamp 50. Stack clamp 50 comprises upper clamp element 56 and lower clamp element 58. Stack clamp upper element 56 is slidably mounted between frame upright members 14 so that it may move in a direction perpendicular to stack clamp lower element 58. Stack clamp lower element 58 preferably remains stationary with respect to frame 12 during clamping. Stack clamp upper element 56 is brought closer to stack clamp lower element 58 by stack clamp actuator 64, which is also used to push upper stack clamp element 56 away from lower stack element 58. A rack and pinion assembly connects opposed sides of the clamp to prevent racking as the clamp element moves up and down. It is clamp actuator 64 which causes stack clamp 50 to exert compressive forces on the stack required to achieve the frictional forces necessary to hold the stack against tension as described above.

Lower stack clamp element 58 preferably comprises a stack conveyor 60 which is driven by stack conveyor motor 62. Stack conveyor 60 will move the stack into the apparatus to a plane of separation between pivot clamp 44 and stack clamp 50. Stack conveyor motor 62 drives stack conveyor 60 through stack conveyor mechanism which is preferably a chain drive driven through a gear reducer (not shown). Alternately, stack clamp lower element 58 may be a flat plate, and the stack may be pushed onto the plate by the stack feed conveyor 63 of FIG. 4.

Pivot clamp 44 is disposed between subframe side members 30 and subframe upper cross member 32. Pivot clamp 44 is configured similar to stack clamp 50 in mirrored relationship to the stack clamp. Pivot clamp 44 comprises upper pivot clamp element 46 and lower pivot clamp element 48. Lower pivot clamp element 48 is preferably a bundle conveyor 66. Bundle conveyor 66 is driven by bundle conveyor motor 68 and bundle conveyor drive mechanism 70. Bundle conveyor drive mechanism is preferably a chain drive driven through a gear reduction drive (not shown).

As with stack clamp 50, upper pivot clamp element 46 is slidably mounted between subframe side members 30 so as to move in a direction perpendicular to pivot clamp lower element 48. Another rack and pinion arrangement is also provided here between the pivot frame 22 and clamp element 46 to prevent racking as the upper pivot clamp element 46 moves up and down. Pivot clamp lower element 48 preferably remains stationary with respect to subframe 22 during clamping. Pivot clamp upper element is moved in proximity to and away from pivot clamp lower element 48 by pivot clamp actuator 72.

In the preferred embodiment, stack clamp actuator 64 and pivot clamp actuator 72 are combined into a single clamp actuator 74, shown in FIG. 8 and described more fully below.

Stack clamp upper element 56 and pivot clamp upper element 46 may be fitted with deformable pads 76. Deformable pads 76 may be filled with low pressure air, gel or other fluid or deformable material allowing the deformable pads to conform to the shape of the stack of sheets received between clamps 50 and 44. This allows irregularities in the top surface of the stack of sheets to be accommodated so that pressure is assured of being applied across the entire stack of sheets in the event of an uneven stack.

Stack clamp 50 is disposed between frame side members 14, as described above. Since pivot clamp 44 is nonpivotably disposed with respect to subframe side members 30 as described above, it can be seen that as subframe 22 pivots about pivot shaft 38, pivot clamp 44 will also pivot about the same axis (FIG. 2A).

The horizontal positions of stack clamp upper element 56 and pivot clamp upper element 46 may be adjusted by hand wheels 78 connected to gear racks (not shown) on the elements to allow adjustment of the horizontal gap or distance between the two clamps.

The Conveyors

As described above, conveyors 60 and 66 not only convey the stack into and out of the apparatus, but they also form the lower element of each respective clamp.

Since it is desirable to keep the stack and the bundle to be separated from the stack in tension during the separation process, any slack in the system of the apparatus which would allow tension imposed on the stack to be relieved is to be avoided. Since the stack and the bundle will rest on the conveyor belts of lower stack clamp conveyor 60 and bundle conveyor 66, it is desirable to keep the conveyor belts in tension to avoid any slack which may contribute to relieving tension on the stack. This is done simply by driving the conveyor belts from the infeed end and the outfeed end, so the belts will remain in tension even during pivotal motion of the subframe.

Referring to FIG. 4, it is understood that a conveyor belt driven by a drive shaft will have a tension end and a "slack end." Bundle conveyor 66 is shown as having bundle conveyor belt 80 which is driven by bundle conveyor drive roller 83, which is in turn driven by bundle conveyor drive mechanism 70 at the outfeed end, which is preferably a chain drive as described above. In order to move bundles 92 from the pivot clamp 44 out of the apparatus to the right, bundle conveyor drive roller 83 will rotate in a clockwise direction so as to cause bundle conveyor belt 80 to move the bundle in the preferred direction. Bundle conveyor belt 80 has bundle conveyor belt top side 81 and bundle conveyor belt bottom side 82. Stack conveyor 60 is similarly equipped, with the exception that its belt is driven from the infeed end, to act against tension as the two conveyors are pivoted apart during the separating procedure.

Stack conveyor 60 and bundle conveyor 66 are operated in response to the control scheme described more fully below.

Pressure Sensors

The clamps 50 and 44 of FIG. 3 are operably connected to pressure sensors 84. Pressure sensors 84 are shown as being connected in the hydraulic lines to the two clamp, cylinders exemplified in FIG. 3 or the single clamp cylinder 126 of the preferred form shown in FIG. 8.

As has been described previously, it is desirable to exert a sufficient force on the stack and bundle to generate the frictional forces required to allow the stack to be put in sufficient tension to separate the bundle from the remainder of the stack. These compressive forces are exerted on the stack by stack clamp actuator 64 and on the bundle by pivot clamp actuator 72, as described previously. As was also described, too high of a compressive force may result in damage to the stack particularly when the material is a relatively porous material such as corrugated fiberboard.

It is possible to determine by calculation, experiment, or experience the compressive forces required to grasp the stack and bundle sufficiently tightly, as well as the compressive force which will result in damage to the stack of material. Providing the apparatus with pressure sensors 84 allows the clamp actuators 64 and 72 to be operated within a range of pressures which will allow for sufficient frictional forces to be imparted to the stack without damaging the stack.

Referring to the hydraulic schematic in FIG. 3, the hydraulic cylinder actuators 64 and 72 are connected to a pump 87 through a directional flow valve 85. The valve is controlled through a programmed microprocessor control 86 to extend and retract the cylinders. In retracting the cylinders close the clamp elements 46, 56 and in extending, open the clamps. A pressure sensing transducer 84 is located in the hydraulic circuit to sense pressure in the lines. As the clamps close and engage the stack, pressure in the hydraulic lines increase. The increased pressure is sensed by the transducer 84 which sends a signal of between 2 and 20 milliamps, depending upon the pressure sensed, to the microprocessor 86. When the transducer signal input reaches the programmed set point in the controller, the valve 85 shifts and locks the clamps in position at the selected clamping pressure. A check valve 88 ensures the clamps remain stationary when not being driven to open. Now the controller can operate the appropriate valving to actuate the spreader 42 to pivot the subframe 22 to separate the clamped bundle from the stack. After the bundle is separated, the controller causes the spreader to retract. At the beginning of the return motion of the spreader and subframe 22, the directional valve is actuated to extend the clamp actuators, releasing their grip on the remainder of the stack and the separated bundle to prevent any bundle damage as the conveyor 66 return to its starting position. Now the separated bundle can be conveyed away from the remainder of the stack, and the process can be repeated. The process is repeated for each nicked bundle of blanks in the stack, so the individual bundles are progressively separated and removed from the stack until none are left, as discussed further below.

In the preferred embodiment wherein a single clamp actuator 74 (shown in FIG. 8) is used, a single control mechanism similar to that shown for pivot clamp 44 may be employed.

Since greater and lesser compressive forces may be required to hold the stack in tension, and since certain stack materials may be more subject to damage or more resilient depending on the material, it is understood that the control scheme used by microcomputer 86 to calculate the forces to be determined by clamp actuator 64 and 72 may be varied and user controlled through an appropriate touch panel (not shown) thereby giving the user the ability to select appropriate operational pressures according to the stacked materials to be separated.

As was described previously, at times the separation line for a bundle will not traverse a stack orthogonally but may have an offset imposed due to the desired shape of the final bundle to be separated from the stack. For example, a separation line may traverse the sheet partway, then change directions, as shown by example in FIG. 16. In this case, the separation line will lie between two planes $P_1$ and $P_2$ orthogonal to the sheet. If the stack clamp 50 and pivot clamp 44 are too close together, it is possible that the upper clamp elements may in fact over-clamp portions containing one or both planes $P_1$ and $P_2$. For example, where the separation line offsets, it is possible that the upper stack clamp 50 may clamp part of the stack which properly belongs to the bundle portion. In order to prevent this over clamping, the apparatus is preferably provided with adjustment mechanism allowing one or the other or both of the clamp elements 46 and 56 to be separated a further distance apart. An example of such an adjustment mechanism would be the hand wheels 78 which operate a screw adjuster or rack and pinion arrangements that allow the clamp elements 46 and 56 to be adjusted fore and aft in a position perpendicular to the upright elements 14 and 30.

Control Scheme/Operation of the Apparatus

The apparatus of the present invention is preferably provided with a control scheme to enhance the speed and operation of the apparatus.

Figure 11:
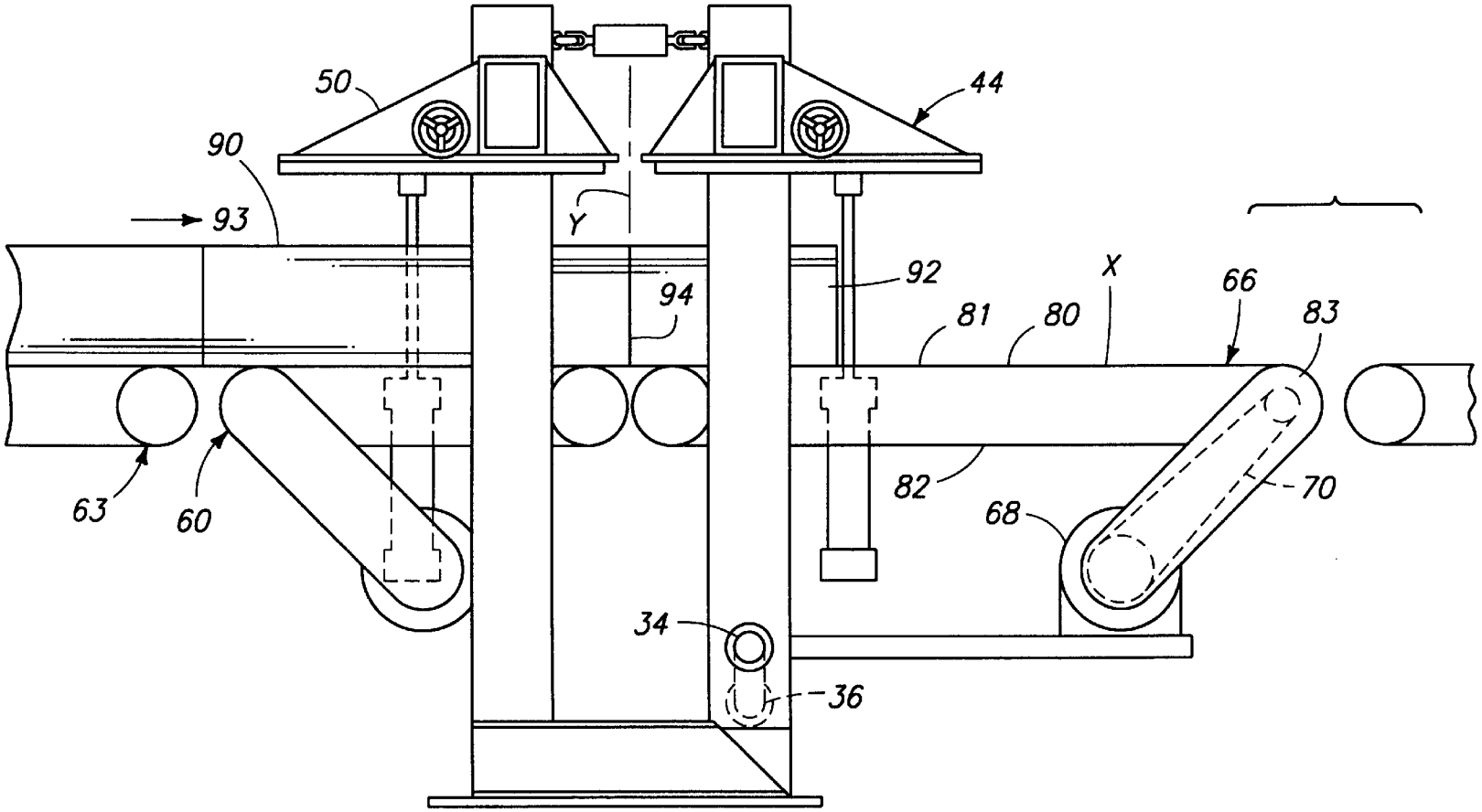
FIG. 11 is a flow diagram showing the control system for the system of the present invention.
Figure 11:
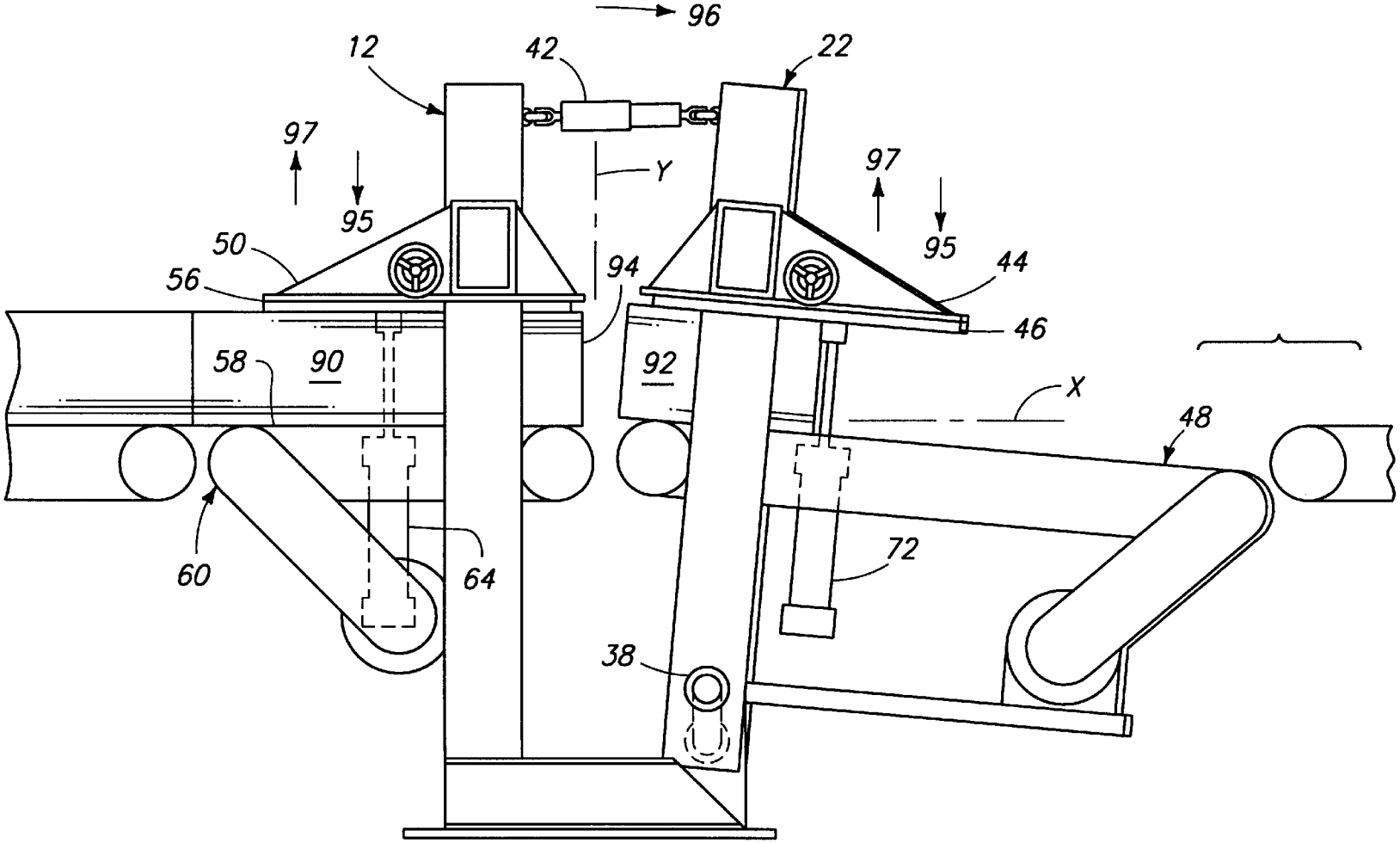
Figure 11:
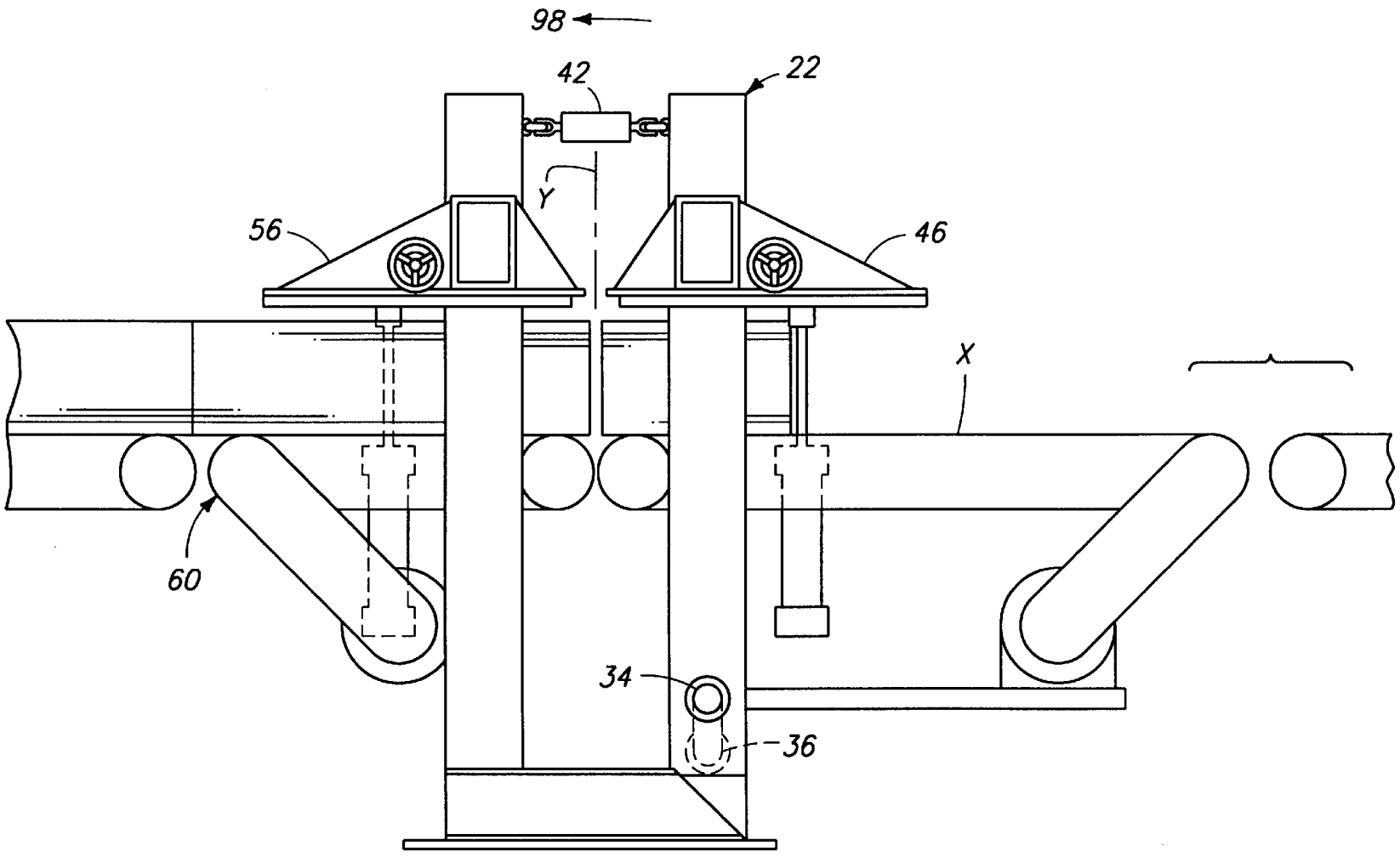
Figure 11:
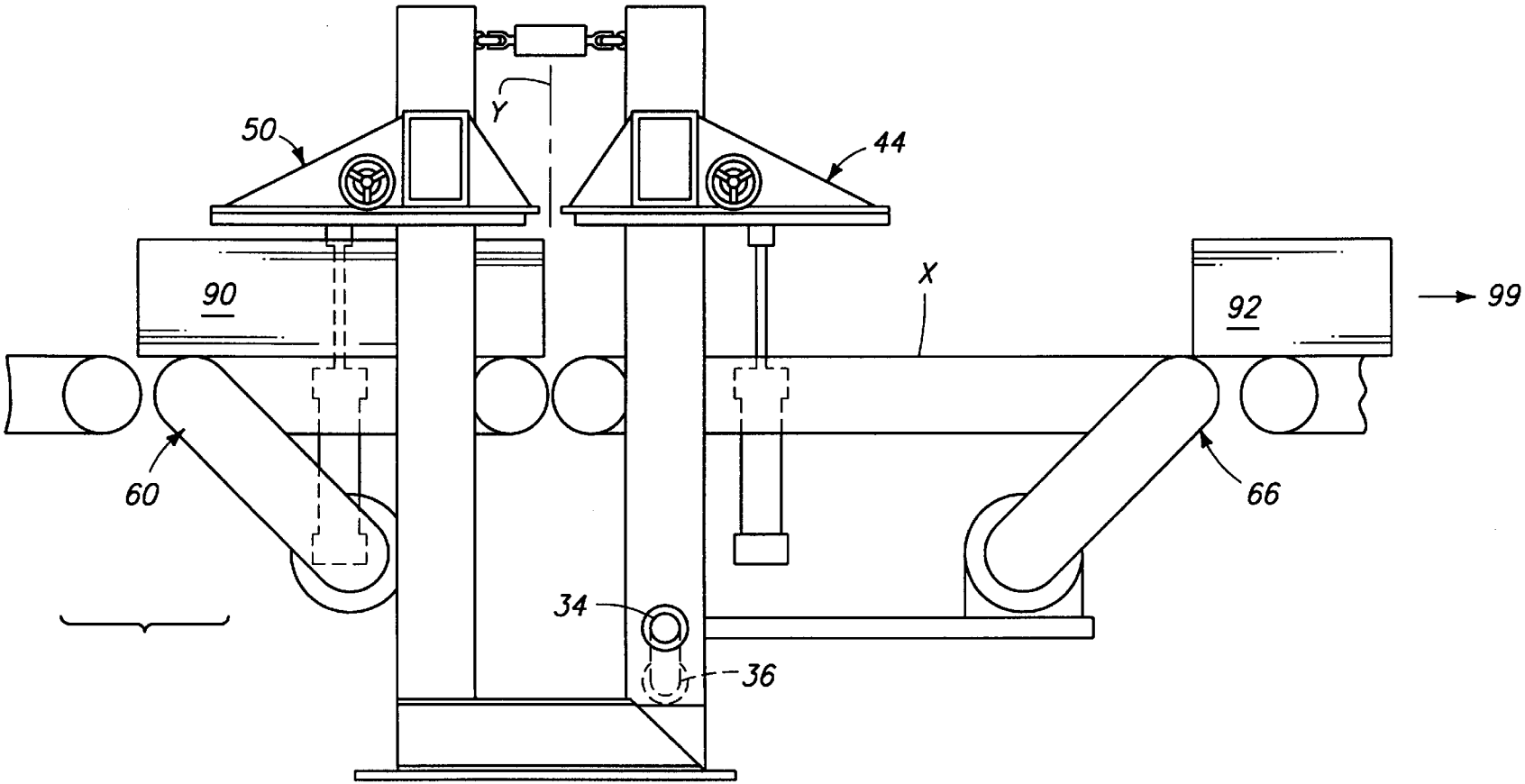

The control scheme is shown in the flow chart diagram of FIG. 11. The control scheme may be entered into microprocessor 86 in the form of a control program. The control scheme may be implemented by actuating the components of the apparatus as described below by use of solenoids, relays, and other control schemes known for actuating electric motors, hydraulic and pneumatic actuators, and other mechanisms necessary for actuating machinery.

In the first step of the control scheme which also comprises one method of the present invention, in step 102 of FIG. 11, which is graphically shown in FIG. 4, the stack of sheets of material 90 from which a bundle 92 is to be separated is urged forward in the feed direction 93 by the feed conveyor 60 and the bundle separating conveyor 66. The stack including the bundle to be separated is advanced until the bundle is positioned under pivot clamp 44. The separation plane 94 between the bundle 92 and the remainder of the stack 90 is positioned at a desired location between the pivot clamp 44 and the stack clamp 50.

Since the length of the bundle 92 will be known to the operator of the apparatus, and since the conveying distance of the bundle separating conveyor 66 may be controlled to advance the stack and bundle a known distance, it is possible to operate stack conveyor 60 and bundle separating conveyor 66 for only that period of time necessary to advance the bundle into the pivot clamp 44 to position the separation plane 94 in the desired position.

Once the separation plane has been located to the desired position, the conveyors will stop and the stack will be stationary in the apparatus.

Moving to step 104 of FIG. 11, which is shown in graphical representation in FIG. 5, stack clamp actuators 64 and 72 will be actuated so as to pull stack clamp upper element 56 in direction 95 and into contact with stack 90, and pivot clamp upper element 46 will be pulled in direction 95 and into contact with bundle 92. The forces applied by clamp actuators 64 and 72 will be applied as directed by the pressure sensing control scheme described above.

Once the stack and bundle have been clamped with the requisite clamping forces, step 106 of the control scheme of FIG. 11 is implemented which is shown in graphical representation in FIG. 5. In step 106 of the control scheme, the spreader ram 42 is actuated to cause subframe 22 to pivot about pivot shaft 38 in direction 96 away from frame 12. Pivot clamp 44 will pivot away from stack clamp 50 causing the bundle 92 to separate from the stack 90 as described above under the discussion of the subframe.

The next step in the control scheme is step 108 of FIG. 11, also portrayed in FIG. 5. Once the bundle 92 has been separated from the remainder of the stack 90, the clamp actuators 64 and 72 will force the upper clamp elements in the direction 97 away from the bundle and stack. The bundle and stack are unclamped as described above prior to returning the subframe to its original position so that any sheets which do not lie entirely in the separation plane 94 will be free to slide within the stack rather than being crushed by the sheets in the bundle as the bundle is returned to its original position.

Following the unclamping process, step 110 of the control scheme of FIG. 11 is implemented which returns the subframe 22 to its original position. With reference to FIG., 6 the step of returning the subframe 22 by activating hydraulic spreader ram 42 to move subframe 22 in direction indicated by arrow 98 is shown. It should be observed that stack clamp upper element 56 and pivot clamp upper element 46 are in their "upward" or unclamped positions during this operation.

Returning to FIG. 11, it is seen that the next step in the control scheme, step 112, is to remove the separated bundle from the pivot clamp and advance the remainder of the stack to insert the next bundle into the pivot clamp. Step 112 of the control scheme is shown in graphical representation in FIG. 7. Bundle conveyor 66 is actuated to remove bundle 92 in the direction shown by arrow 99. Preferably, stack conveyor 60 is actuated after a slight delay to advance the remainder of the stack 90 into the pivot clamp 44 in the manner described for step 102 shown in FIG. 11 and pictorially displayed in FIG. 4.

Advancing of stack 90 is preferably done after a delay to assure that the separated bundle will completely exit on conveyor 66 before the stack is advanced and positioned for the next separating cycle.

Steps 102 through 112 of the control scheme of FIG. 11 are repeated until the remainder of the stack 90 is a single bundle. At that point, there is no remaining stack for the bundle to be separated and rather than repeating steps 104 through 110 which are steps required for breaking a bundle from the remainder of the stack, the remaining stack portion is merely advanced through the apparatus with the previous bundle separated from the stack. In this manner, throughput may be maximized.

Preferred Clamp Actuator

Figure 8:
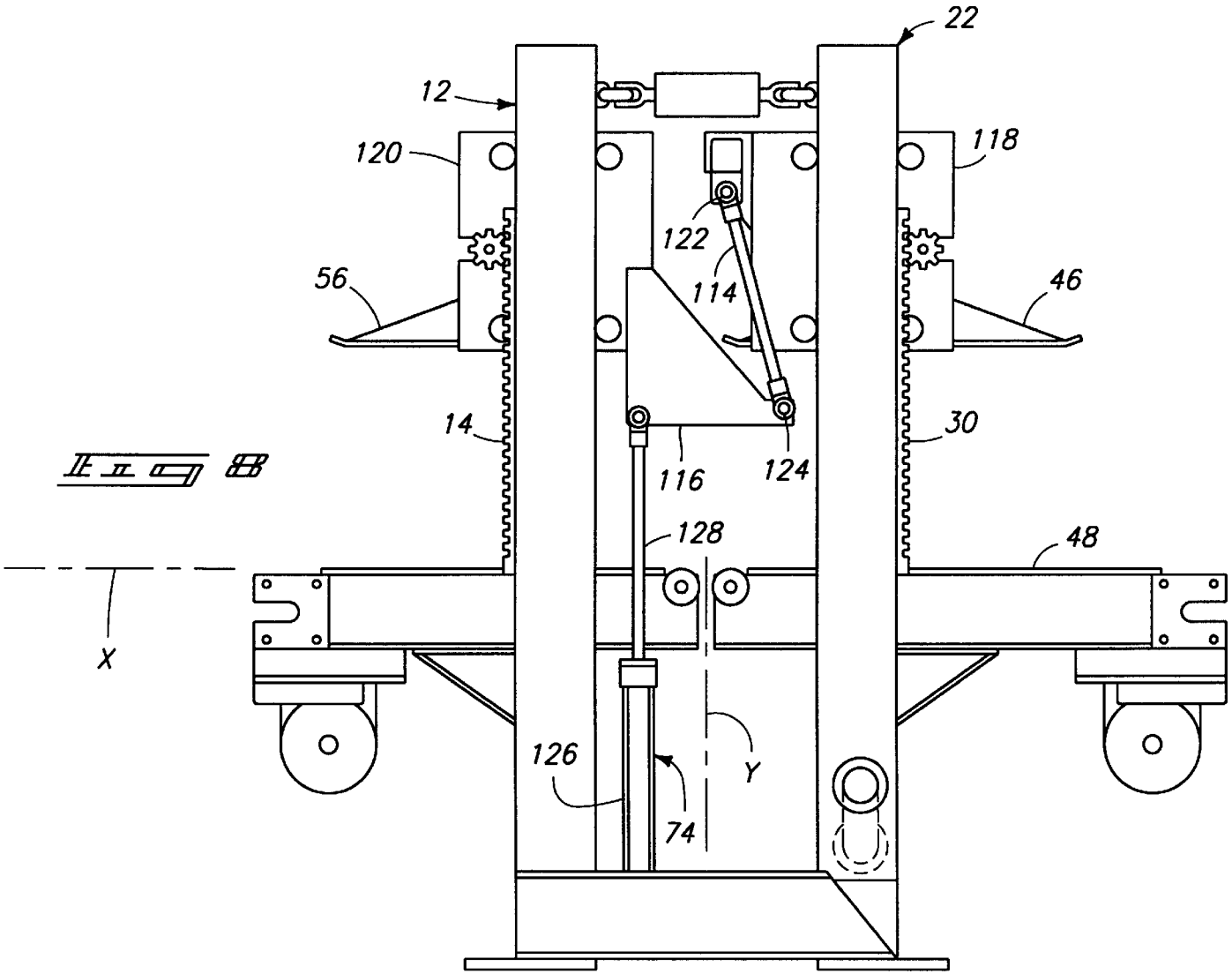
FIG. 8 is a side elevational view of the preferred apparatus with the preferred clamp actuator and clamps in a retracted position.

In the preferred embodiment the stack clamp actuator 64 and the pivot clamp actuator 72 are advantageously replaced with a single clamp actuator 74 shown in FIG. 8, thereby providing single actuator control of both clamp assemblies.

The preferred clamp actuator 74 comprises a single hinged link 114 which is connected to pivot clamp side plate 118 which is in turn connected to pivot clamp upper element 46 in a fixed manner. Hinged link 114 is pivotally attached to pivot clamp side plate 118 at pivot clamp hinge point 122 at a first end. Hinged link 114 is pivotally attached to a linkage plate 116 at linkage plate hinge point 124 at the other end of the hinged link 114. Linkage plate 116 is fixedly attached to stack clamp side plate 120 which is in turn fixedly attached to stack clamp upper element 56. Linkage plate 116 is further connected to the cylinder rod 128 of clamp actuator cylinder 126.

When hydraulic actuator 126 is actuated so as to pull cylinder rod 128 in a downward direction, the linkage plate 116 is pulled in the direction causing stack clamp upper element 56 to move in a downward direction. By virtue of the hinged link 114, the pivot clamp upper element 46 is also caused to move in a downward direction toward pivot clamp lower element 48. Again, the rack and pinion assemblies at either side of the machine join the clamp assemblies to the respective frame elements in order to avoid racking as the clamps move up and down.

Figure 9:
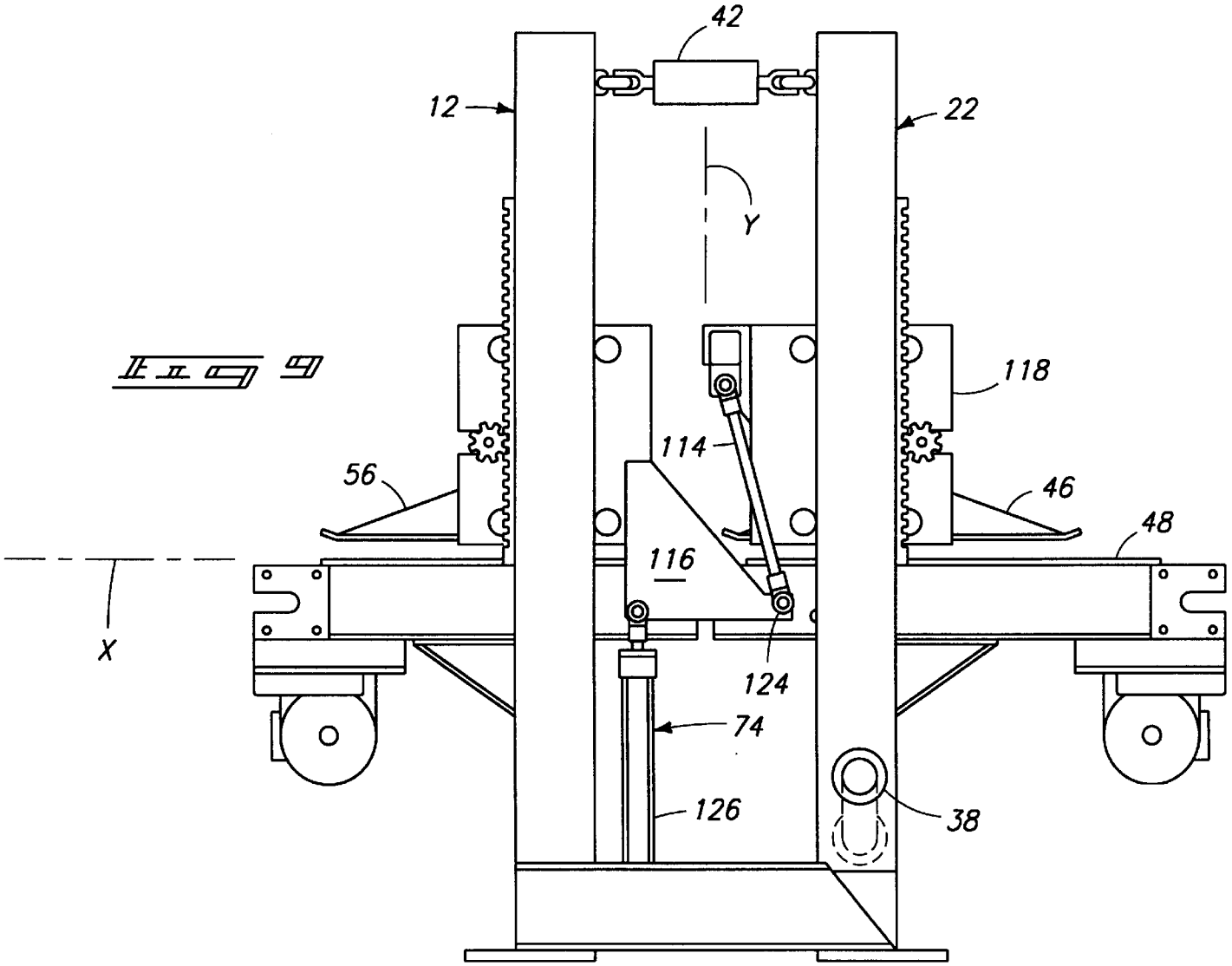
FIG. 9 is a side elevational view of the preferred apparatus showing the clamps in the clamping position.

FIG. 9 shows the position of the stack clamp upper element 56 and the pivot clamp upper element 46 after the hydraulic clamp actuator 126 has been actuated so as to pull linkage plate 116 in the downward direction. When spreader 42 is activated so as to push subframe 22 away from frame 12, pivot clamp side plate 118 will also rotate about the pivot shaft 38 causing hinged link 114 to rotate about linkage plate hinge point 124.

Figure 10:
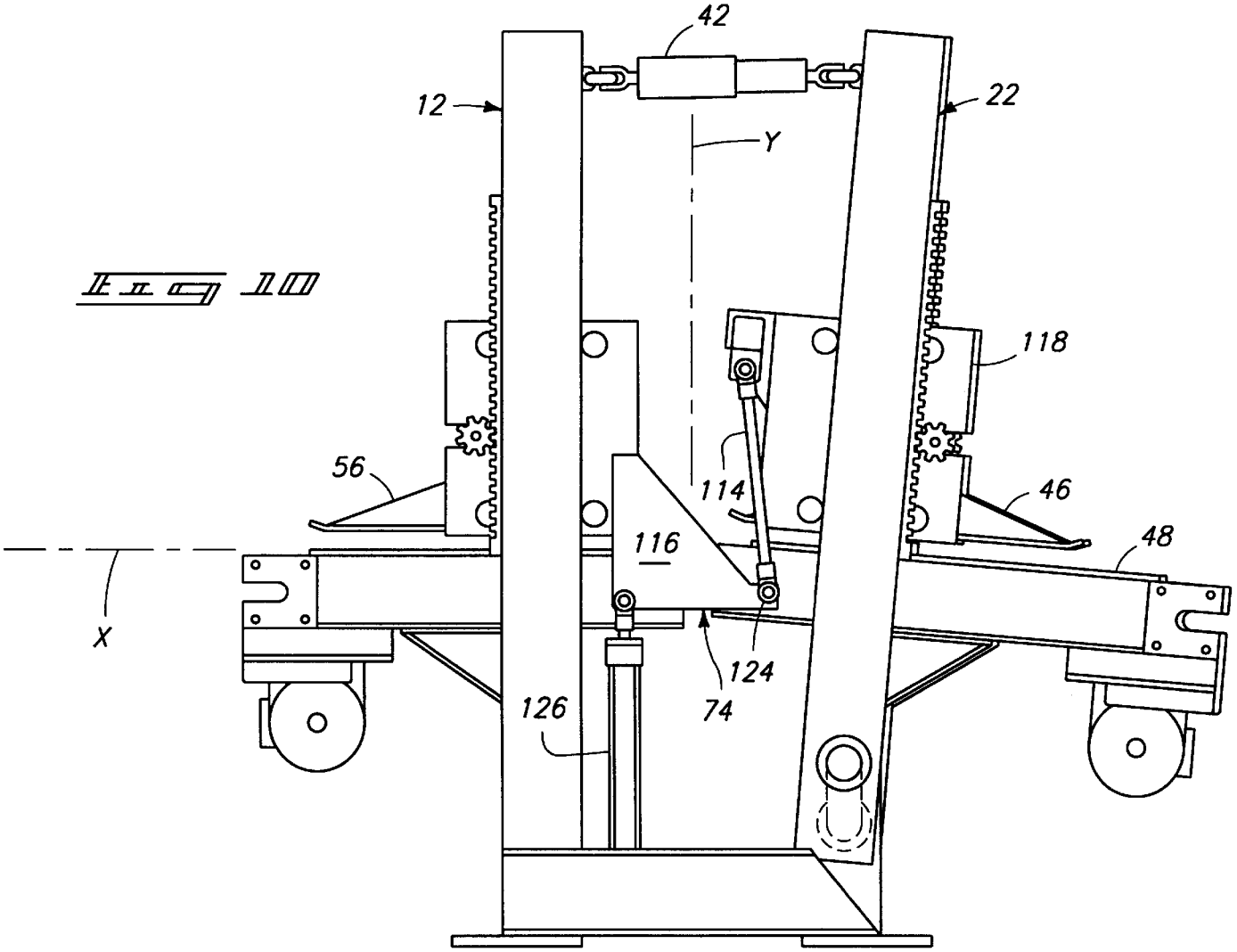
FIG. 10 is a side view of the preferred apparatus showing the preferred clamp actuator with the subframe in a pivoted position.
Figure 11:
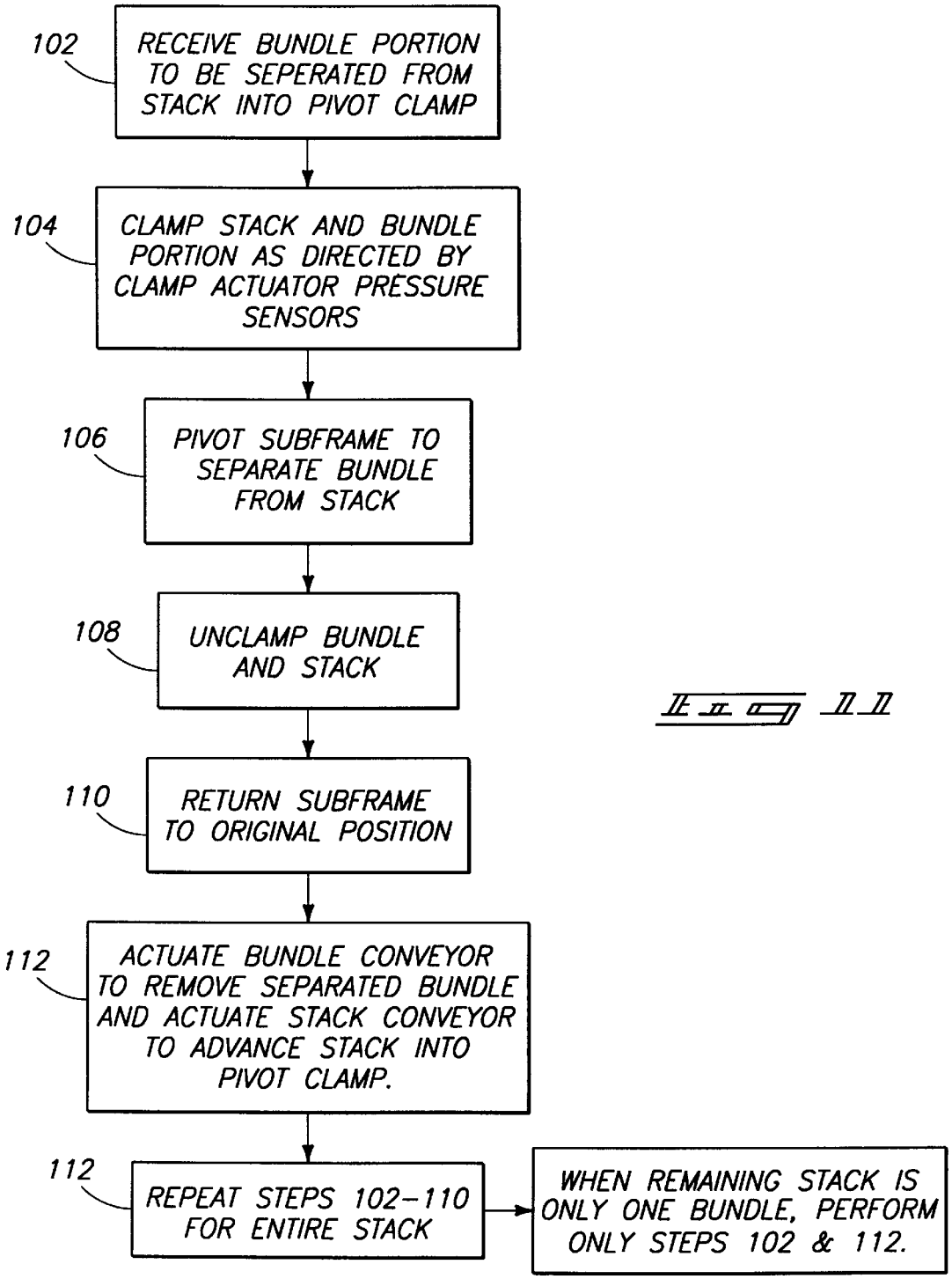
Figure 11:
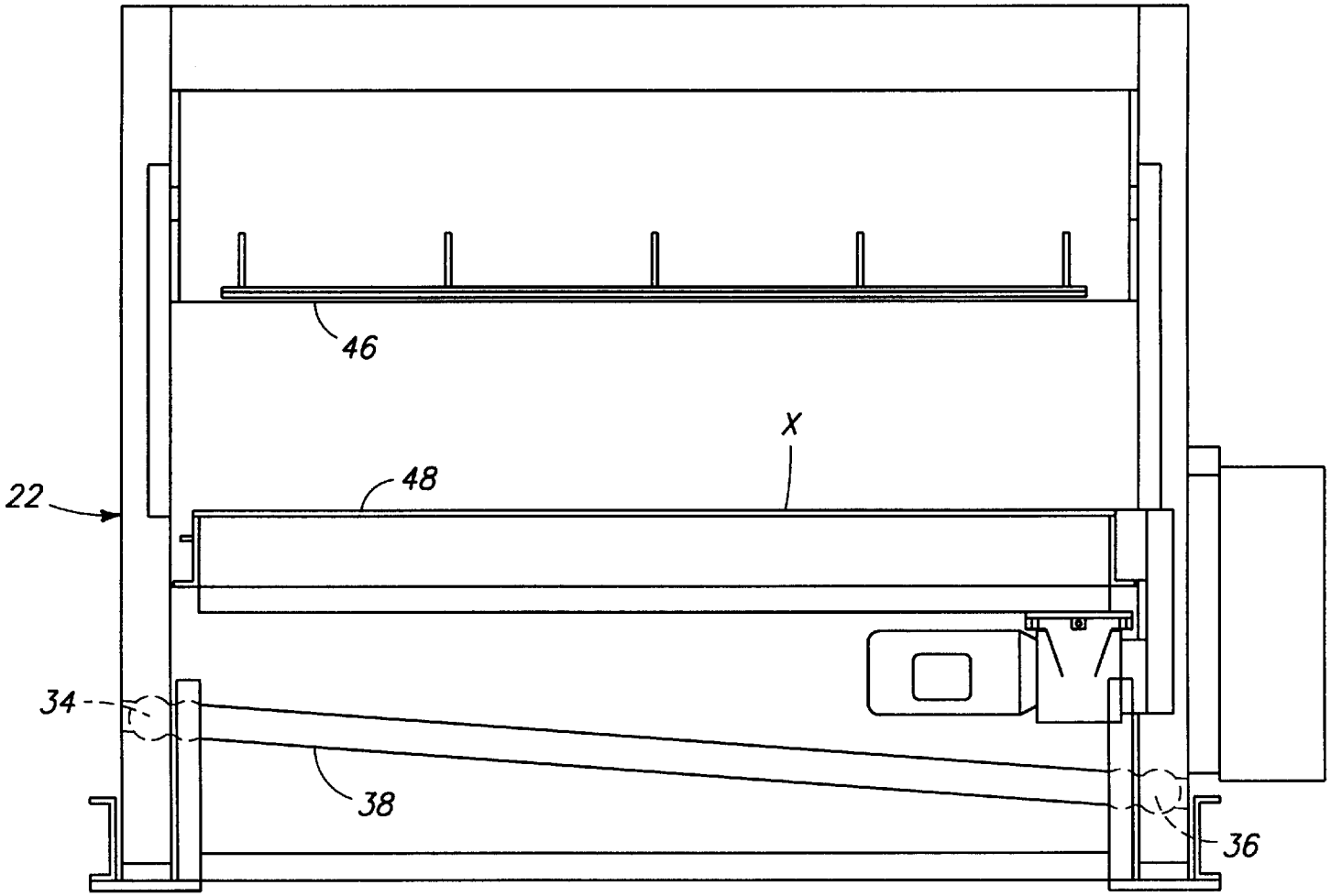

Referring to FIG. 10, the movement of the hinged link as a result of the pivoting action of subframe 22 is shown, with the subframe slightly skewed as a result of the angled pivot axis of the shaft 38.

The Method

In the method of the present invention, a novel technique for separating a stack of sheets along a separation line intersecting the sheets in the stack is disclosed. As described previously, the separation line between the bundle to be separated from the stack of sheets and the remaining stack may not transverse the stack in single orthogonal plane but may change directions in so transversing the stack.

The method requires that the portion of the stack to be separated into a separate bundle of pieces be securely clamped or grasped so as to hold the sheets tightly together. The remainder of the stack of sheets from which the bundle portion is to be separated is also clamped or grasped in a firm manner. Typically, the sections to be separated from the remainder of the stack will be delineated by a weakened separation line such as by perforations, embossing, or other partial cutting or weakening of the sheet. This cutting or partial weakening will create an area of weak tensile strength within the sheet. If the sheets are stacked so that the separation lines are roughly aligned in the stack, then by exerting a tensile force on either side of the collection of separation lines grouped together to define a bundle, the bundle will be pulled away from the stack.

In the method of the present invention, one part of the stack (a bundle) is grasped or clamped and is pivoted with respect to the remaining portion of the stack. The grasped bundle is rotated about an axis which must be skewed so as to intersect: (a) a plane X containing the sheets in the stack; (b) a separation plane Y; or (c) both planes X and Y. Rotating the bundle in such a manner results in an initial tearing or separation of the sheet most distal from the pivot axis, starting from the corner most distal from the axis of rotation.

As the rotation of the bundle continues, the tearing, breaking or separating in tension of the bundle from the stack will progress from the corner of initial separation down towards the corner of the stack most proximate to the axis of rotation. Thus the nicks joining the blanks along the separation plane will break sequentially, rather than all or many at once.

In this manner, the minimal force required to initiate separation of the bundle to be separated from the stack may be applied. Consequently, the compressive forces required by the clamping of the stack which are necessary to exert the requisite tensile forces necessary to initiate separating may be minimized. This minimizes the risk of damage to the stack by clamping the stack too tightly.

The further method of separating a series of bundles from a stack of sheets having a plurality of separation lines in each sheet is described above under the control system and operation of the apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. Apparatus for separating a stack of sheets of materials at a separation plane intersecting said sheets, comprising:

a first clamp for securely clamping said stack in a direction normal to a stack plane intersecting the separation plane;

a second clamp for securely clamping said stack in a direction normal to said stack plane; and wherein said first clamp and said second clamp are located on opposite sides of said separation plane, and wherein said second clamp pivots with respect to said first clamp along a skewed axis which intersects at least one of said planes to initiate progressive separation of said stack from a point on said stack.

2. The apparatus of claim 1 further comprising a spreader disposed between said first clamp and said second clamp, said spreader positioned so as when actuated to cause said second clamp to pivot about said axis with respect to said first clamp.

3. The apparatus of claim 1 further comprising at least one clamp actuator for actuating at least one clamp of said clamps, said at least one clamp comprising an upper clamp element and a lower clamp element, said actuator configured to draw said upper clamp element and said lower clamp element into proximity to one another during clamping and thereby apply a clamping pressure to said stack.

4. The apparatus of claim 3 wherein at least one clamp element of said upper and lower clamp elements further comprises:

a pressure sensor for sensing clamping pressure applied to said stack and generating a pressure signal in response thereto; and a clamping pressure feedback loop which acts in response to said pressure signal to control said clamping pressure.

5. The apparatus of claim 3 wherein said lower clamp element comprises a conveyer for moving said stack into and out of said first and second clamps.

6. The apparatus of claim 1 wherein a distance between at least one clamp of said first and second clamps and said separation plane may be adjusted.

7. Apparatus for separating a stack of sheets of materials, each of said sheets having a separation path defined by a weakened section, all said separation paths of said sheets lying between two planes; an area between said two planes defining a separation zone, comprising:

a first clamp for securely clamping said stack in a direction substantially normal to a stack plane intersecting the two planes;

a second clamp for securely clamping said stack in a direction substantially normal to said stack plane; and wherein said first clamp and said second clamp are located on opposite sides of said separation zone, and said second clamp pivots with respect to said first clamp along a skewed axis which intersects.

8. The apparatus of claim 7, further comprising:

a frame;

wherein said first clamp is disposed on the frame for clamping said stack;

said frame further comprising frame support members attached to said frame for supporting said frame on a surface;

a sub-frame;

wherein said second clamp is disposed on the subframe and includes a lower second clamp element wherein said sub-frame is pivotally mounted to said frame support members at respective first and second pivot points to allow said sub-frame to pivot with respect to said frame;

said first and said second pivot points lying along said axis; and a ram disposed between said frame and said sub-frame for moving said frame and said subframe apart about said axis, thereby causing said sub-frame to pivot about said first and second pivot points.

9. The apparatus of claim 8 wherein said first clamp comprises a lower first clamp element and an upper first clamp element, said upper first clamp element being movable in a direction perpendicular to said lower first clamp element; and wherein said second clamp further comprises an upper second clamp element, said upper second clamp element being movable in a direction perpendicular to said lower second clamp element.

10. The apparatus of claim 9 wherein said lower first clamp element comprises a first conveyer for moving a portion of said stack into and out of said first clamp.

11. The apparatus of claim 10 wherein said lower second clamp element comprises a second conveyer for moving the separated bundle out of said second clamp.

12. The apparatus of claim 11 wherein each of said first and second conveyors comprises a conveyor belt and a conveyor belt drive, each of said first and second conveyors having a drive zone wherein each conveyor belt is in contact with said stack of sheets, and further wherein said conveyor belt drives are configured such that said conveyor belts within said drive zone are in tension.

13. The apparatus of claim 9 wherein said upper first clamp element and said upper second clamp element are connected by a hinged link to allow said upper second clamp element to move in an arcuate path away from said upper first clamp element in response to pivoting of said subframe; and wherein said hinged link is connected to a clamp actuator for moving said upper first clamp element and said upper second clamp element in a direction perpendicular to their respective lower clamp elements.

14. The apparatus of claim 8 wherein said ram is hydraulically actuated.

15. The apparatus of claim 8 further comprising:

a first cross member on said frame above said first clamp;

a second cross member on said sub-frame above said second clamp; and wherein said ram is disposed between said first cross member and said second cross member.

16. The apparatus of claim 8 wherein said first pivot point and said second pivot point are connected by a pivot shaft.

17. The apparatus of claim 7 further comprising a pressure sensor operably connected to each respective clamp for determining pressure exerted on said stack by each said clamp.

18. The apparatus of claim 7 wherein each of said first and second clamps includes an upper clamp element with a deformable pad positioned thereon to engage stacks having irregular heights.

* * * * *

UNITED STATES PATENT AND TRADEMARK OFFICE

CERTIFICATE OF CORRECTION

PATENT NO. : 6,019,267

DATED : February 1, 2000

INVENTOR(S) : David Shill et al.

It is certified that error appears in the above-indentified patent and that said Letters Patent is hereby corrected as shown below:

Col. 5, line 4
replace "is attached"
with --attached--.

Col. 7, line 7
replace "subframe is"
with --subframe--.

Signed and Sealed this

Tenth Day of April, 2001

*Attest:*

Nicholas P. Godici

NICHOLAS P. GODICI

*Attesting Officer*

*Acting Director of the United States Patent and Trademark Office*